US010968731B2

(12) United States Patent
Gupta et al.

(10) Patent No.: US 10,968,731 B2
(45) Date of Patent: Apr. 6, 2021

(54) SYSTEM AND METHOD FOR MONITORING A BLOWOUT PREVENTER

(71) Applicant: Cameron International Corporation, Houston, TX (US)

(72) Inventors: Anshul Gupta, Houston, TX (US); Wenyu Zhao, Houston, TX (US); Gilbert Haddad, Houston, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 97 days.

(21) Appl. No.: 15/357,973

(22) Filed: Nov. 21, 2016

(65) Prior Publication Data

US 2018/0142543 A1 May 24, 2018

(51) Int. Cl.

| | |
|---|---|
| ***E21B 47/001*** | (2012.01) |
| ***E21B 33/035*** | (2006.01) |
| ***E21B 33/06*** | (2006.01) |
| ***E21B 33/064*** | (2006.01) |

(52) U.S. Cl.

CPC ..... *E21B 47/001* (2020.05); *E21B 33/0355* (2013.01); *E21B 33/063* (2013.01); *E21B 33/064* (2013.01)

(58) Field of Classification Search

CPC ..... E21B 47/001

See application file for complete search history.

(56) References Cited

U.S. PATENT DOCUMENTS

| | | | | |
|---|---|---|---|---|
| 8,978,699 | B2 | 3/2015 | Jaffrey et al. | |
| 2004/0059510 | A1* | 3/2004 | Thompson, Jr. .... | E21B 41/0021 702/6 |
| 2007/0090315 | A1* | 4/2007 | Bolz ..... | F02D 41/20 251/129.04 |
| 2013/0311093 | A1* | 11/2013 | Winters ..... | E21B 47/06 702/6 |
| 2014/0064029 | A1 | 3/2014 | Jaffrey | |
| 2014/0123746 | A1 | 5/2014 | Jaffrey et al. | |
| 2014/0166264 | A1* | 6/2014 | Judge ..... | E21B 33/063 166/66 |
| 2014/0231075 | A1 | 8/2014 | Springett et al. | |
| 2015/0177403 | A1 | 6/2015 | Haugen et al. | |
| 2015/0233398 | A1 | 8/2015 | Jaffrey | |
| 2016/0131692 | A1 | 5/2016 | Jaffrey | |

(Continued)

FOREIGN PATENT DOCUMENTS

| | | | |
|---|---|---|---|
| WO | 2012/102775 | A2 | 8/2012 |
| WO | 2014130703 | A2 | 8/2014 |

OTHER PUBLICATIONS

International Search Report and Written Opinion for the equivalent International patent application PCT/US2017/061418 dated Feb. 26, 2018.

(Continued)

*Primary Examiner* — Hyun D Park

(57) ABSTRACT

A monitoring system includes a processor configured to receive sensor data from one or more sensors positioned about a mineral extraction system, input the sensor data into a model to generate a health index predictive of a future condition of a component of a blowout preventer (BOP) stack assembly of the mineral extraction system, and to provide an output indicative of the future condition of the component of the BOP stack assembly.

21 Claims, 5 Drawing Sheets

(56) References Cited

U.S. PATENT DOCUMENTS

| | | | | |
|---|---|---|---|---|
| 2016/0186516 | A1 | 6/2016 | Jaffrey | |
| 2016/0215608 | A1 | 7/2016 | Jaffrey | |
| 2016/0237773 | A1 | 8/2016 | Dalton et al. | |
| 2016/0306831 | A1 | 10/2016 | Holmes et al. | |
| 2016/0371406 | A1* | 12/2016 | Nicholas | G06F 17/5009 |
| 2017/0061208 | A1* | 3/2017 | Basu | G06K 9/00536 |
| 2017/0308802 | A1* | 10/2017 | Ramsoy | H04L 63/0421 |

OTHER PUBLICATIONS

International Preliminary Report on Patentability for the equivalent International patent application PCT/US2017/061418 dated May 31, 2019.

* cited by examiner

SYSTEM AND METHOD FOR MONITORING A BLOWOUT PREVENTER

BACKGROUND

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

A blowout preventer (BOP) stack is installed on a wellhead to seal and control an oil and gas well during drilling operations. A drill string may be suspended inside a drilling riser from a rig through the BOP stack and into the well bore. During drilling operations, a drilling fluid is delivered through the drill string and returned up through an annulus between the drill string and a casing that lines the well bore. In the event of a rapid invasion of formation fluid in the annulus, commonly known as a "kick," BOPs within the BOP stack may be actuated to seal the annulus and to control fluid pressure in the wellbore, thereby protecting well equipment disposed above the BOP stack. Current systems may not effectively monitor a condition (e.g., health and/or degradation) of various components within the BOP stack, and it may be difficult to determine when to perform repairs and/or maintenance operations.

BRIEF DESCRIPTION OF THE DRAWINGS

Various features, aspects, and advantages of the present invention will become better understood when the following detailed description is read with reference to the accompanying figures in which like characters represent like parts throughout the figures, wherein.

DETAILED DESCRIPTION OF SPECIFIC EMBODIMENTS

Figure 1:
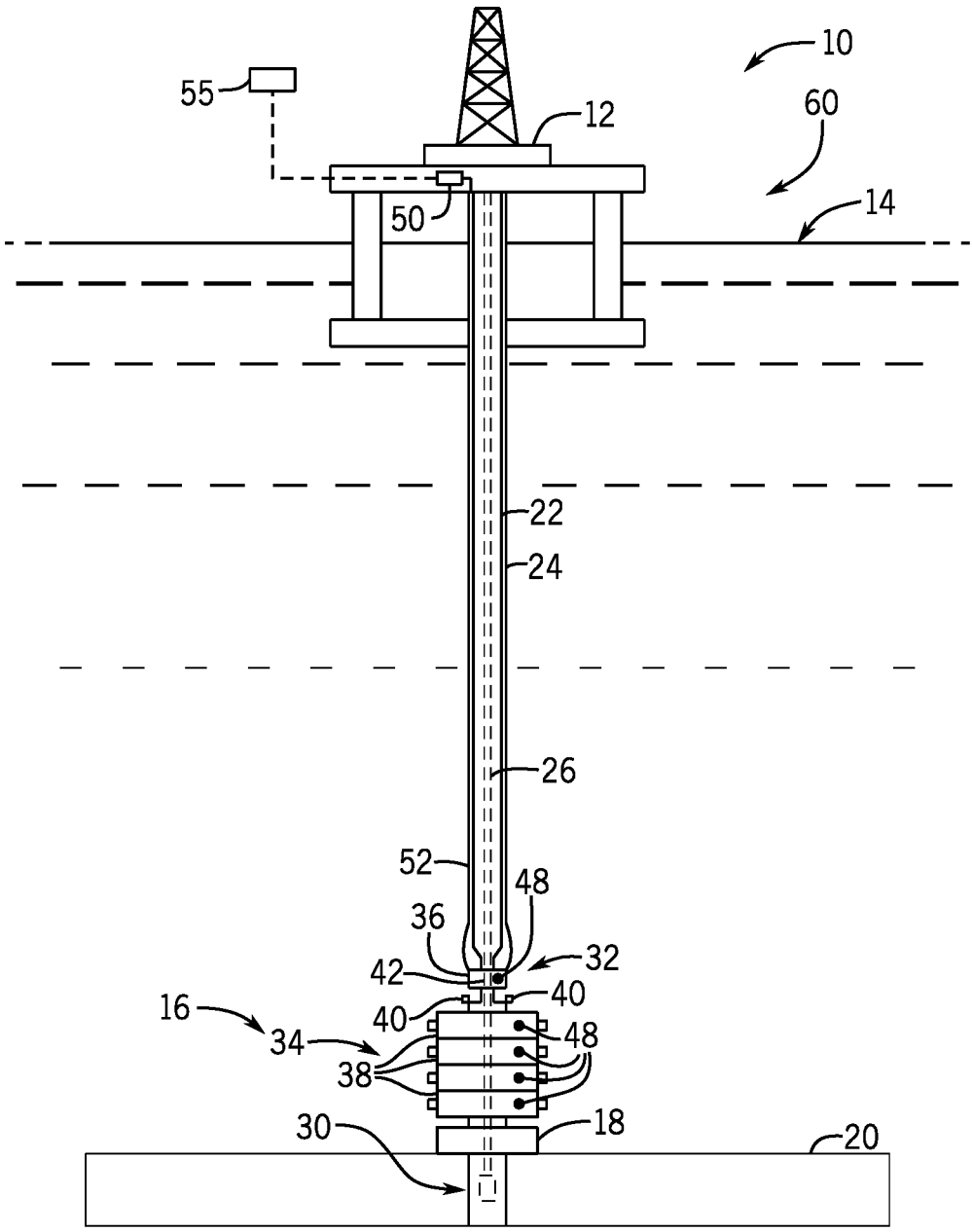
FIG. 1 is a schematic diagram of an offshore system having a blowout preventer (BOP) stack assembly, in accordance with an embodiment of the present disclosure.

One or more specific embodiments of the present disclosure will be described below. These described embodiments are only exemplary of the present disclosure. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

The present embodiments are generally directed to systems and methods for monitoring components of a blowout preventer (BOP) stack assembly of a mineral extraction system. In some embodiments, a monitoring system may include one or more sensors positioned about the BOP stack assembly and/or at various other locations of the mineral extraction system to monitor respective parameters (e.g., pressure, fluid flow rate, temperature, fluid content, such as gas content or solids content, fluid properties, such as viscosity, angle of inclination, ram position, power supply, or the like) and to generate respective sensor data. In certain embodiments, the monitoring system may include one or more controllers (e.g., electronic controller) and/or a computational platform (e.g., digital platform or computing device) configured to use predictive analytics to analyze the sensor data, build (e.g., train and test) a model (e.g., predictive model), calculate an index (e.g., health index or health score), determine a condition and/or predict a future condition of components of the BOP stack assembly, estimate remaining life of components of the BOP stack assembly, and/or predict maintenance needs for components of the BOP stack assembly, for example. The disclosed embodiments may extend the life of components of the BOP stack assembly, reduce downtime, reduce operating costs, and/or facilitate scheduling maintenance operations.

To facilitate discussion, certain embodiments described herein relate to monitoring components of the BOP stack assembly; however, it should be understood that the systems and methods may be adapted to monitor any of a variety of other components (e.g., risers, diverters, valves, seals, packers, such as diverter packers and telescopic joint packers, connectors, Christmas trees, wellheads, or the like) of the mineral extraction system. Furthermore, while certain embodiments disclosed herein relate to subsea mineral extraction systems, it should be understood that the systems and methods may be adapted to monitor components of on-shore (e.g., land-based) mineral extraction systems.

With the foregoing in mind, FIG. 1 is a schematic diagram of an embodiment of an offshore system 10. The offshore system 10 includes an offshore vessel or platform 12 at a sea surface 14. A BOP stack assembly 16 is mounted to a wellhead 18 at a sea floor 20. A tubular drilling riser 22 extends from the platform 12 to the BOP stack assembly 16. The riser 22 may return drilling fluid or mud to the platform 12 during drilling operations. In the illustrated embodiment, one or more conduits 24 configured to support pressurized hydraulic fluid (e.g., BOP control fluid) extend along the outside of the riser 22 from the platform 12 to the BOP stack assembly 16. Downhole operations are carried out by a tubular string 26 (e.g., drill string) that extends from the platform 12, through the riser 22, through the BOP stack assembly 16, and into a wellbore 30.

The BOP stack assembly 16 is configured to control and seal the wellbore 30, thereby containing hydrocarbon fluids (liquids and gases) therein. In the illustrated embodiment, the BOP stack assembly 16 includes a lower marine riser package (LMRP) 32 and a BOP stack 34. As shown, the LMRP 32 is positioned between (e.g., removably coupled to) the riser 22 and the BOP stack 34, and the BOP stack 34 is positioned between (e.g., removably coupled to) the LMRP 32 and the wellhead 18. The BOP stack assembly 16 may include one or more annular BOPs 36, one or more ram BOPs 38, one or more controllers 40 (e.g., control unit or control pod having an electronic controller with a processor and memory), or any combination thereof.

Each annular BOP 36 may include an annular elastomeric sealing component that is mechanically squeezed radially inward (e.g., via the hydraulic fluid) to seal about the tubular string 26 and/or to block a flow through an annular bore 42 about the tubular string 26. Each ram BOP 38 may include a pair of opposed rams and a pair of actuators (e.g., hydraulic actuators) configured to actuate and drive the corresponding rams via the hydraulic fluid. In the illustrated embodiment, the BOP stack 34 includes four ram BOPs 38. In particular, the BOP stack 34 includes an upper ram BOP 38 that includes opposed blind shear rams or blades configured to sever the tubular string 26 and/or to seal the wellbore 30 from the riser 22 and three lower ram BOPs 38 each having opposed pipe rams configured to contact the tubular string 26 and/or to block the flow through the annular bore 42 about the tubular string 26. In the illustrated embodiment, one annular BOP 36 and multiple controllers 40 (e.g., redundant controllers) are provided in the LMRP 32, and multiple ram BOPs 38 are provided in the BOP stack 34. It should be understood that the BOP stack assembly 16 may include different types of ram BOPs, a different number of ram BOPs, a different number of annular BOPs, one or more controllers, or combinations thereof, in any suitable arrangement.

As discussed in more detail below, each controller 40 may be configured to control various components (e.g., valves, rams, actuators, or the like) of the BOP stack assembly 16. For example, each controller 40 may be configured to provide control signals to control one or more valves to adjust a flow of hydraulic fluid (e.g., the hydraulic fluid from the conduits 24) through the BOP stack assembly 16, such as to drive the annular BOP 36 and/or the ram BOPs 38 between an open position which enables fluid flow through the annular bore 42 and a closed position which blocks fluid flow through the annular bore 42. The one or more controllers 40 may also be configured to receive signals from one or more sensors 48 positioned at various locations about the BOP stack assembly 16. The one or more sensors 48 may be configured to monitor respective parameters (e.g., pressure, fluid flow rate, temperature, fluid content, angle of inclination, power supply, ram position, or the like) and to generate respective signals (i.e., sensor data). For example, the one or more sensors 48 may include one or more pressure sensors configured to measure pressure within the wellbore 30, the LMRP 32, the riser 22, and/or various other components (e.g., diverters, accumulators of the BOP stack assembly 16, or the like) of the offshore system 10. The one or more sensors 48 may include flow meters configured to detect fluid flow rate through various fluid conduits of the BOP stack assembly 16, the annular bore 42, the riser 22, and/or various other components of the offshore system 10. The one or more sensors 48 may include inclination sensors configured to measure an angle of inclination (e.g., relative to the sea floor 20, the riser 22, and/or a horizontal axis of an absolute coordinate system) of the LMRP 32, the BOP stack 34, and/or various other components of the offshore system 10. The one or more sensors 48 may include temperature sensors configured to measure a temperature at the controller 40, the wellbore 30, the annular bore 42, within various conduits of the BOP stack assembly 16, and/or at various other components of the offshore system 10. In some embodiments, the one or more sensors 48 may include a meter (e.g., multimeter) to test a power supply (e.g., to the one or more controllers 40). The one or more sensors 48 may include a position sensor (e.g., switch, optical sensor, or acoustic sensor) configured to measure a position of the ram of the ram BOPs 38, a position of a valve (e.g., open or closed), or the like. The one or more sensors 48 may include fluid sensors configured to measure a characteristic (e.g., chemical composition, gas content, water content, pH, particle or sediment characteristics [e.g., size, type, count, and/or concentration], mix concentrate ratio, glycol concentration, water hardness, salinity, presence of inorganic and/or organic compounds, alkalinity, conductivity, microbial inhibitor concentration, and/or viscosity) of various fluids (e.g., drilling mud, gas, oil, hydraulic control fluid use to drive certain components [e.g., rams, pistons, valves, or the like] of the BOP stack assembly 16). The one or more sensors 48 and/or the characteristics measured by the one or more sensors 48 may include any of the sensors and/or the characteristics disclosed in U.S. Publication No. 2016/0215608, which is herein incorporated by reference in its entirety for all purposes.

In some embodiments, the one or more controllers 40 may be coupled (e.g., electrically coupled) to a controller 50 (e.g., electronic controller) at the platform 12 via one or more cables 52 (e.g., Multiplexer [MUX] cables). The controller 50 may communicate with each controller 40 to provide control signals (e.g., based on an operator input) and/or to receive the sensor data. In some embodiments, a computational platform 55 (e.g., digital platform or computing) may be provided to process the sensor data. As discussed in more detail below, the one or more sensors 48, the one or more controllers 40, the controller 50, and/or the computational platform 55 may be part of a monitoring system 60 that is configured to obtain sensor data and/or to use predictive analytics to analyze the sensor data from the sensors 48, build (e.g., train and test) a model (e.g., predictive model), calculate an index (e.g., health index or health score), determine a condition and/or predict a future condition of components of the BOP stack assembly 16, estimate remaining life of components of the BOP stack assembly 16, and/or predict maintenance needs (e.g., schedule maintenance) for components of the BOP stack assembly 16, for example. The monitoring system 60 may be configured to determine the condition, predict the future condition, estimate the remaining life, and/or predict maintenance needs of various components, including connectors (e.g., between the LMRP 32 and the BOP stack 34, wellhead connectors, choke and kill line connectors, or the like), gaskets (e.g., at the LMRP 32, at the wellhead connector, or the like), seals (e.g., a packer seal of the ram BOP 38, an annular packer seal of the annular BOP 36, a gate valve seal, or the like), blind shear ram BOPs 38, pipe ram BOPs 38, the annular BOP 36, choke and kill lines, valves (e.g., kill isolation valve, choke isolation valve, bleed valves, choke valves, shuttle valves, solenoid valves, or the like), accumulators of the BOP stack 44, locks (e.g., S/T locks), a power supply (e.g., battery), sensors (e.g., the one or more sensors 48), or any of a variety of other components of the BOP stack assembly 16.

Figure 2:
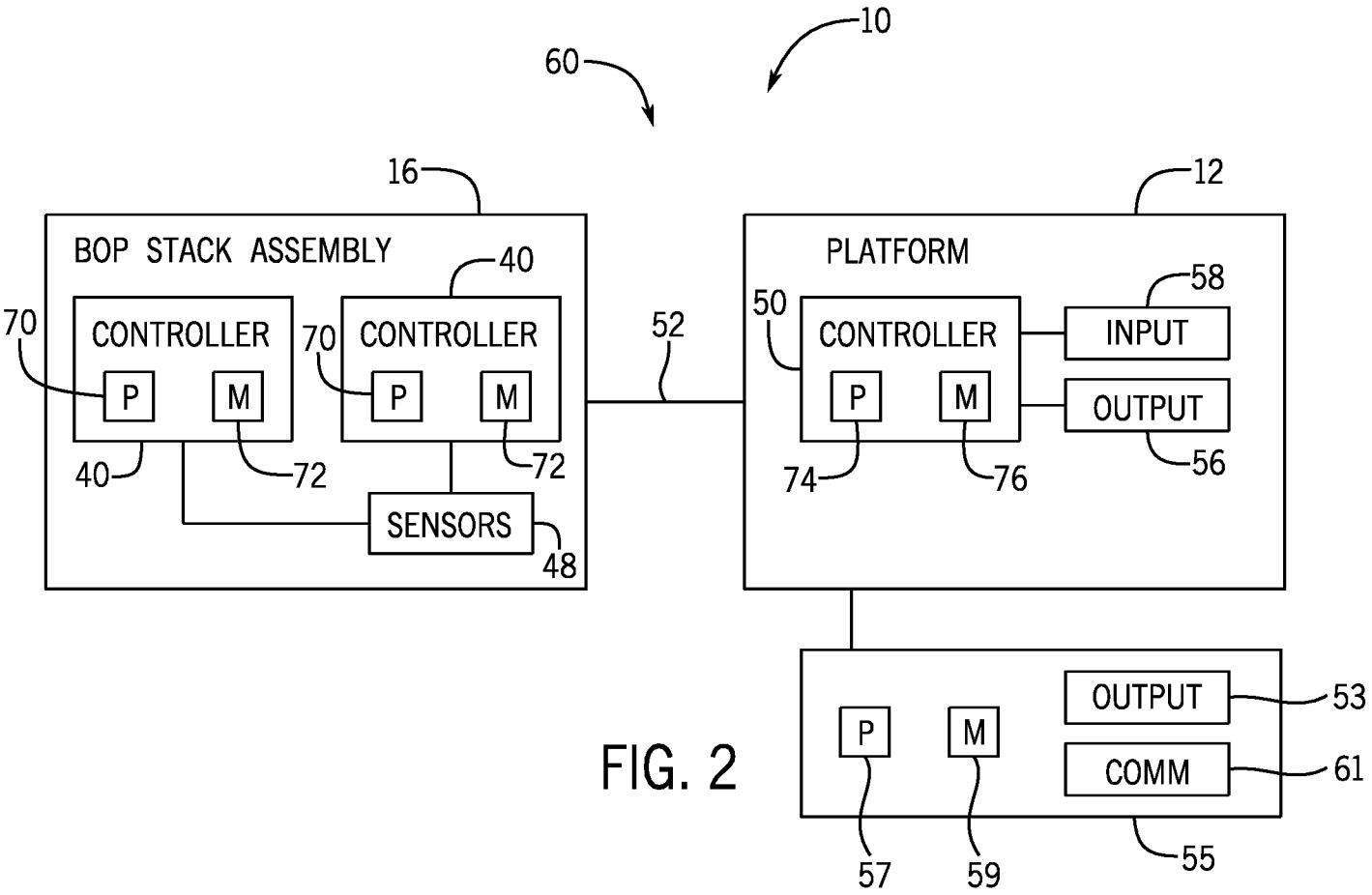
FIG. 2 is a schematic diagram of a monitoring system that may be utilized with the offshore system of FIG. 1, in accordance with an embodiment of the present disclosure.

FIG. 2 is a schematic diagram of the monitoring system 60 that may be used with the offshore system 10. As shown in FIG. 2, the monitoring system 60 may include the one or more controllers 40 (e.g., at a subsea location, such as within the BOP stack assembly 16), the one or more sensors 48

(e.g., at a subsea location, such as within the BOP stack assembly 16), and the controller 50 (e.g., at a surface location, such as at the platform 12) that is communicatively coupled to the one or more controllers 40, such as via the cable 52. In the illustrated embodiment, the monitoring system 60 includes the computational platform 55, which may include components located at a remote base station (e.g., on-shore base station). However, in some embodiments, some or all of the components of the computational platform 55 may be located at the platform 12 or any of a variety of other suitable locations.

As discussed in more detail below, the one or more sensors 48 are configured to generate sensor data indicative of respective parameters, and the one or more controllers 40 are configured to receive the sensor data, store the sensor data, and/or facilitate communication of the sensor data to the controller 50 and/or to the computational platform 55. In certain embodiments, the computational platform 55 may be configured to use predictive analytics to analyze the sensor data, train and test a model (e.g., predictive model), calculate an index (e.g., health index or health score), determine a condition and/or predict a future condition of components of the BOP stack assembly 16, estimate remaining life of components of the BOP stack assembly 16, and/or predict maintenance needs for components of the BOP stack assembly 16, for example.

In some embodiments, the controller 50 may be configured to receive an operator input, such as via an input device 58 (e.g., touchscreen, switch, button, etc.). For example, the operator may provide an input to activate certain sensors 48 and/or to retrieve data from the one or more controllers 40 or other components of the BOP stack assembly 16. In some embodiments, the controller 50 and/or the one or more controllers 40 may be configured to provide control signals to various actuators of the BOP stack assembly 16 to initiate a test protocol (e.g., to test operation of the ram BOPs 38, the annular BOP 36, seals formed by the ram BOPs 38 and/or the annular BOP 36, wellbore pressure containment, or the like) at predetermined intervals (e.g., approximately every 1, 2, 3, 4, 8, 16, 24, 48, 72 hours or more) and/or in response to certain events (e.g., completion of the well, changes in wellbore pressure, a user input or instruction via the input device 58, or the like). Thus, in operation, the BOP stack assembly 16 may be periodically tested via such test protocols. In certain embodiments, at various times, such as before, during, and/or after such test protocols, the one or more controllers 40 and/or the controller 50 may control the one or more sensors 48 to monitor the respective parameters. For example, in some embodiments, certain sensors 48 may be operated to monitor respective parameters during the test protocol (e.g., during an entirety of the test protocol and/or during certain portions of the test protocol), and the sensor data obtained during the test protocol may be stored at the one or more controllers 40 and/or the controller 50 and/or provided to the computational platform 55 for analysis (e.g., to train and test the model, to calculate the health index, to determine the condition and/or to predict the future condition of the component, to estimate remaining life, and/or to generate a maintenance schedule). In some embodiments, the computational platform 55 may only use sensor data collected during one or more test protocols for analysis and/or to train and to test the model. In some embodiments, the computational platform 55 may only use sensor data collected when certain BOPs (e.g., the annular BOP 36 and/or the pipe ram BOPs 38) of the BOP stack assembly 16 are in a closed position to contain wellbore pressure, such as during certain test protocols and/or in response to sudden increases in wellbore pressure, for analysis and/or to build the model.

In some embodiments, the computational platform 55 may be configured to provide an output (e.g., an alarm and/or an indication of the condition and/or prediction of the future condition of the component, the remaining life of the component, and/or the maintenance needs for the component), such as via an output device 53 (e.g., a display or a speaker). For example, in some embodiments, the output device 53 may provide an audible alarm, a textual message, a health index (e.g., a numerical value), a remaining life value (e.g., percentage remaining, years remaining, or the like), and/or a maintenance schedule (e.g., approximate date) for one or more components of the offshore system 10. In some embodiments, the computational platform 55 may be configured to determine an appropriate or recommended action and/or instruct the output device 53 to provide a prompt, such as a suggestion that a particular test of the BOP stack assembly 16 be initiated and/or that one or more tests be performed more frequently (e.g., to confirm and/or more frequently update a health index, remaining life value, and/or maintenance schedule) based on the condition of the component. For example, in some embodiments, the computational platform 55 may be configured to recommend an increase in test frequency as the health index decreases. In some embodiments, the computational platform 55 may be configured to recommend that one or more tests be delayed or performed less frequently (e.g., to extend the life of the components of the BOP stack assembly 16) based on the condition of the component. In certain embodiments, the computational platform 55 may provide instructions to the controller 50 to cause the controller 50 to output a control signal to automatically initiate a certain test, adjust the test protocols, adjust the test schedules (e.g., frequency with which the test protocols are carried out), and/or operate actuators and/or other components of the BOP stack assembly 16 (e.g., to adjust fluid flow, adjust injection chemicals, close the ram BOP 38 and/or the annular BOP 36, or the like) based on the sensor data, the determined condition of the component, the determined remaining life of the component, and/or the determined maintenance needs for the component. Thus, the monitoring system 60 may be configured to control actions to improve the health (e.g., operational effectiveness and/or efficiency) and/or the remaining life of the component. It should be understood that the controller 50 may receive information and/or instructions from the computational platform 55 and may be configured to instruct an output device 56 (e.g., display or speaker) at the platform 12 to provide any of the outputs (e.g., alarm, prompts, or the like) disclosed herein.

In the illustrated embodiment, the computational platform 55 is configured to carry out most or all of the processing steps to analyze the sensor data, train and test the model, calculate the health index, determine the condition and/or to predict the future condition of components of the BOP stack assembly 16, estimate remaining life of components of the BOP stack assembly 16, and/or predict maintenance needs for components of the BOP stack assembly 16. However, it should be understood that processing functions described herein with respect to the computational platform 55 may be distributed between the controller 50, the one or more controllers 40, and/or other computing systems and processing components positioned at the BOP stack assembly 16, at various locations of the offshore system 10, at the remote base station, and/or at various other locations. For example, in certain embodiments, the one or more controllers 40 may determine a change in a value of a parameter measured by each sensor 48, and the one or more controllers 40 may provide the change to the computational platform 55 for further processing. In certain embodiments, the one or more controllers 40 may independently (e.g., automatically, according to a predetermined schedule) initiate one or more test protocols, and may provide an indication of the one or more test protocols (e.g., the type of test protocol, a beginning and an end time for the test protocol, or the like) to the controller 50 and/or to the computational platform 55 to facilitate the predictive analytic techniques disclosed herein. Furthermore, the computational platform 55 may include or be part of a supercomputer that utilizes multiple computational platforms 55, a cloud computing system, or the like to distribute the disclosed processes across multiple computing systems.

In the illustrated embodiment, the computational platform 55 includes the output device 53, a processor 57, a memory device 59, a communication component 61 (e.g., wireless or wired component to facilitate communication with the one or more controllers 50 or other computing devices). It should be understood that the computational platform 55 may include other components to enable the computational platform 55 to process the sensor data 80 and/or to provide outputs, for example. In certain embodiments, the controllers (e.g., the one or more controllers 40 and the controller 50) disclosed herein are electronic controllers having electrical circuitry configured to process signals. In the illustrated embodiment, each of the one or more controllers 40 includes a processor, such as the illustrated microprocessor 70, and a memory device 72. As shown, the controller 50 includes a processor, such as the illustrated microprocessor 74, and a memory device 76. The processors 57, 70, 74 may be used to execute instructions or software. Moreover, the processors 57, 70, 74 may include multiple microprocessors, one or more "general-purpose" microprocessors, one or more special-purpose microprocessors, and/or one or more application specific integrated circuits (ASICS), or some combination thereof. For example, the processors 57, 70, 74 may include one or more reduced instruction set (RISC) processors.

The memory devices 59, 72, 76 may include a volatile memory, such as random access memory (RAM), and/or a nonvolatile memory, such as ROM. The memory devices 59, 72, 76 may store a variety of information and may be used for various purposes. For example, the memory devices 59, 72, 76 may store processor-executable instructions (e.g., firmware or software) for the processors 59, 70, 74 to execute, such as instructions for performing test protocols, processing the sensor data, building the model, calculating the health index, determining the condition and/or predicting the future condition of components of the BOP stack assembly 16, estimating remaining life of components of the BOP stack assembly 16, and/or predicting maintenance needs for components of the BOP stack assembly 16. The storage device(s) (e.g., nonvolatile storage) may include read-only memory (ROM), flash memory, a hard drive, or any other suitable optical, magnetic, or solid-state storage medium, or a combination thereof. The storage device(s) may store data (e.g., algorithms, models, thresholds, etc.), instructions (e.g., software or firmware for processing the sensor date, etc.), and any other suitable data. The controllers, processors, and memory devices disclosed herein may have any of the above-described features.

Figure 3:
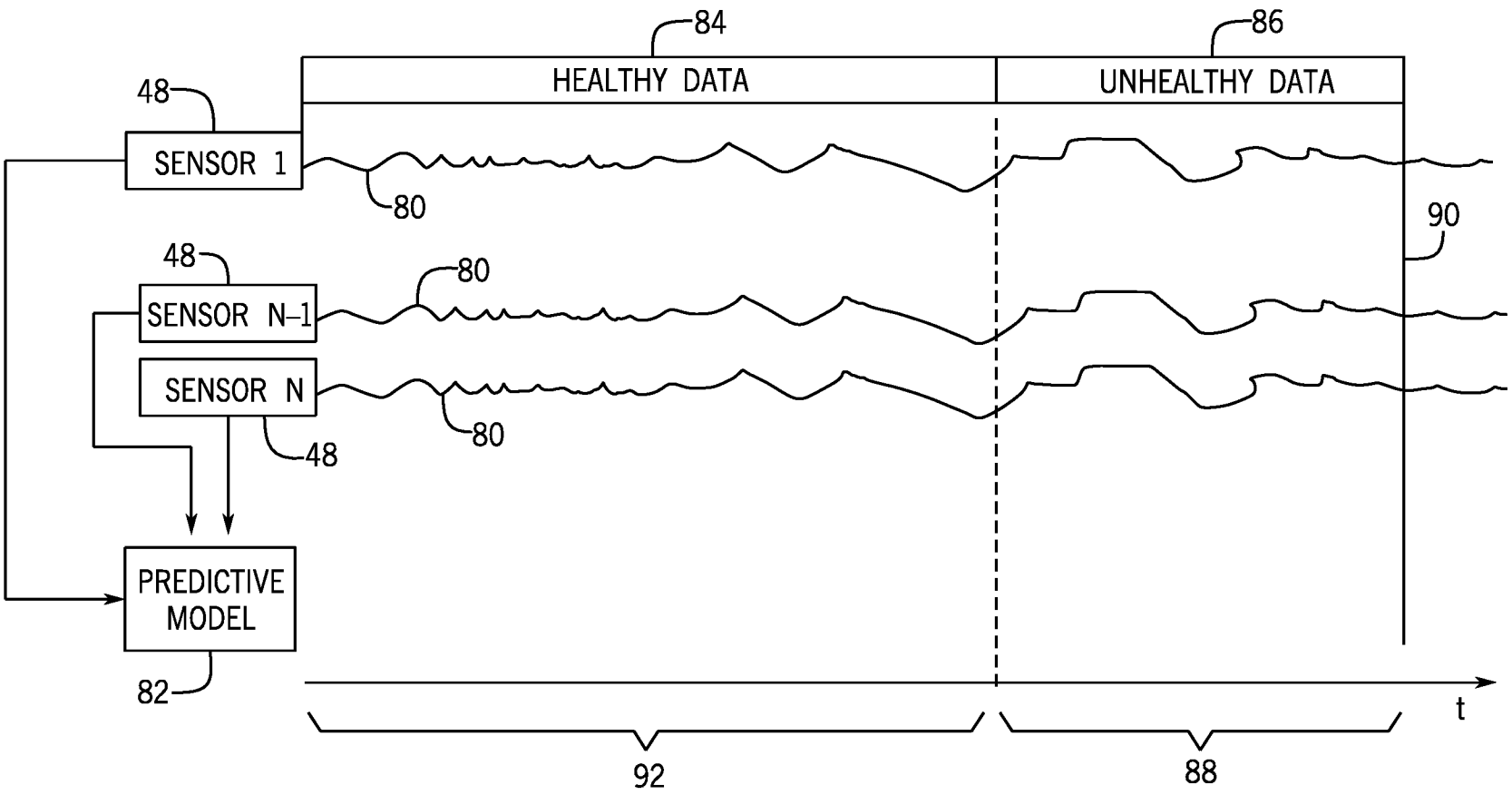
FIG. 3 is a schematic diagram illustrating elements that may be used to build (e.g., train and test) a model with the monitoring system of FIG. 2, in accordance with an embodiment of the present disclosure.

FIG. 3 is a schematic diagram illustrating elements of the predictive analytic techniques that may be carried out by the monitoring system 60, in accordance with an embodiment of the present disclosure. In operation, the one or more sensors 48 may generate respective sensor data 80 (e.g., a signal) and may provide the respective sensor data 80 to the one or more controllers 40 located at the BOP stack assembly 16, which may relay the respective sensor data 80 to the controller 50 (e.g., via the cable 52) and/or the computational platform 55. In some embodiments, the sensor data 80 may be obtained during one or more test protocols. In certain embodiments, the respective sensor data 80 from each sensor 48 may be recorded (e.g., logged) into log files at the computational platform 55 (e.g., the memory device 59). In some embodiments, the log files may include control signals (e.g., commands), such as control signals sent from the controller 50 to the one or more controllers 40 to initiate a test protocol, for example. Thus, in some embodiments, each line in the log files may correspond to the respective sensor data 80 generated by one of the sensors 48 or to a control signal (e.g., sent from the controller 50 to the one or more controllers 40, such as to initiate a test protocol).

The sensor data 80 in the log files may include measurement units, and in some embodiments, the sensor data 80 may be recorded in the following format:

```
<TIMESTAMP><POD_TYPE><SEM_TYPE><SENSOR_NAME>
<OLD_VALUE><SEPARATOR><NEW_VALUE><UNIT>
```

Where TIMESTAMP is the time at which the sensor data was obtained, POD_TYPE indicates a location (e.g., pod) of the BOP stack assembly 16 at which the sensor was recorded, SEM_TYPE indicates the controller 40 at which the sensor data was recorded, SENSOR_NAME indicates the sensor 48 that was utilized to obtain the sensor data, OLD_VALUE indicates first sensor data (e.g., a first data set or an initial value), NEW_VALUE indicates second sensor data (e.g., a second data set or a final value), SEPARATOR may be a delimiter or indicate a boundary between the prior sensor data and the new sensor data, and UNIT indicates units (i.e., measurement units) of the sensor data. The computational platform 55 (e.g., the processor 57) may utilize algorithms (e.g., text-processing algorithms, regular expressions, speech taggers) to locate all of the unique units in the log file database and to group (e.g., sort) lines in the log files based on the units they contain. For each group, the lines may be parsed and the parsed data may be stored, such as into a JavaScript Object Notation (JSON) format, which may have the format shown below:

```
<UNIT>: {
  <SENSOR >:{
    <SEM_TYPE>: [
    {
      "From":<OLD_VALUE>,
      "TimeStamp": <TIMESTAMP>,
      "To": <NEW_VALUE>,
      "SemType": <SEM_TYPE_VALUE>,
      "DataDescription": <SENSOR_NAME>,
      "Unit": <UNIT>
```

The computational platform 55 may combine the JSON for each log file into a single combined JSON for all sensor data 80. The sensor data 80 that is collected and logged in this manner (e.g., baseline sensor data) may be utilized to build a model 82 (e.g., predictive model), which may then be utilized in conjunction with other collected sensor data 80 (e.g., subsequently collected sensor data 80) to calculate a health index, determine a condition and/or predict a future condition of components of the BOP stack assembly 16, estimate remaining life of components of the BOP stack assembly 16, and/or predict maintenance needs for components of the BOP stack assembly 16.

To build the model 82, in certain embodiments, the sensor data 80 may be collected over time and sorted into healthy data 84 and unhealthy data 86. The sensor data 80 may be sorted based on time relative to events, such as component installation, repair events, and/or maintenance events. For example, sensor data 80 collected within a first time window 88 (e.g., 1 week, 2 weeks, 1 month, 2 months, 3 months, or more) prior to a maintenance or repair event 90 may be labeled as unhealthy data 86. Sensor data 80 collected within a second time window 92 (e.g., at times prior to and/or outside of the first window 88 and/or within 1 week, 2 weeks, 1 month, 2 months, 3 months or more after a maintenance or repair event and/or after installation of the component and/or the BOP stack assembly 16) may be labeled as healthy data 84. In some embodiments, the sensor data 80 labeled as unhealthy data 86 may be discarded (e.g., not used to build the model 82), and the sensor data 80 labeled as healthy data 92 may be used to build the model 82 (e.g., only data labeled as healthy data 92 may be used). It should be understood that in some embodiments, unhealthy data 86 may additionally or alternatively be utilized the train and to test the model 82 and/or may be otherwise taken into account to generate the health index, for example. However, in certain circumstances, the available sensor data may include substantially more healthy data 92 than unhealthy data 86, and thus, in some such cases, utilizing only the health date 92 may enable the model 82 to be generated quickly and/or provide reliable outputs.

In certain embodiments, the computational platform 55 may extract various features from the sensor data 80 labeled as healthy data 92 to build the model 82. For example, in some embodiments, the computational platform 55 may calculate a mean change in value of one or more of the parameters over a time window (e.g., 10, 30, 60, 90 minutes), which may be a moving time window, and the respective mean changes may be input into a machine learning algorithm to build the model 82. As noted above, some BOP stack assemblies 16 may include multiple controllers 40, and in some such cases, the computational platform 55 may receive sensor data 80 from the multiple controllers 40, calculate a change in value in the sensor data 80 received from each of the multiple controllers 40, and use a maximum change for any given time to calculate the mean change that is then input to the machine learning algorithm to build the model 82. The mean change of each parameter may be useful for evaluating all of the sensor data 80 together; however, it should be understood that other features of the sensor data 80 may be utilized to build the model 82.

In some embodiments, various other data may be utilized to build the model 82. For example, historical and/or empirical sensor data 80 from one or more mineral extraction systems 10, knowledge-based or expert data related to the components within the mineral extraction system 10, physics-based models of the components within the mineral extraction system 10, computer models of fluids or fluid dynamics within the mineral extraction system 10, materials data of the components within the mineral extraction system 10, structural data of the components of the mineral extraction system 10, or the like) from one or more mineral extraction systems 10, or any combination thereof, may be utilized to build the model 82. Furthermore, in some embodiments, the sensor data 80 and/or the other data may be weighted. In some embodiments, multiple models 82 may be generated, and each model 82 may be indicative of a condition of one or more components of the BOP stack assembly 16. For example, the computational platform 55 may generate one model 82 (e.g., a ram BOP model) to monitor the condition of the ram BOP 38 and another model 82 (e.g., an annular BOP model) to monitor the condition of the annular BOP 36.

As discussed in more detail below, the model 82 may be used by the computational platform 55 to generate a health index, which may be a numerical value (e.g., on a scale of 0 to 1, 1 to 10, 1 to 50, 1 to 100, or the like) and may be indicative of the condition and/or predictive of a future condition of one or more components of the BOP stack assembly 16. A threshold (e.g., a predetermined threshold or range) may be established by the computational platform 55 based on the sensor data 80 and/or the model 82 to define an acceptable health index (e.g., indicative of a properly functioning BOP stack assembly 16). As discussed in more detail below, the model 82 may be utilized to evaluate the BOP stack assembly 16. For example, subsequent sensor data 80 may be fed into the model 82 to calculate the health index, determine a condition and/or to predict a future condition of components of the BOP stack assembly 16, estimate remaining life of components of the BOP stack assembly 16, and/or predict maintenance needs for components of the BOP stack assembly 16. In some embodiments, the subsequent sensor data 80 may also be utilized to build and/or to update the model 82 over time, in the manner set forth above.

Figure 4:
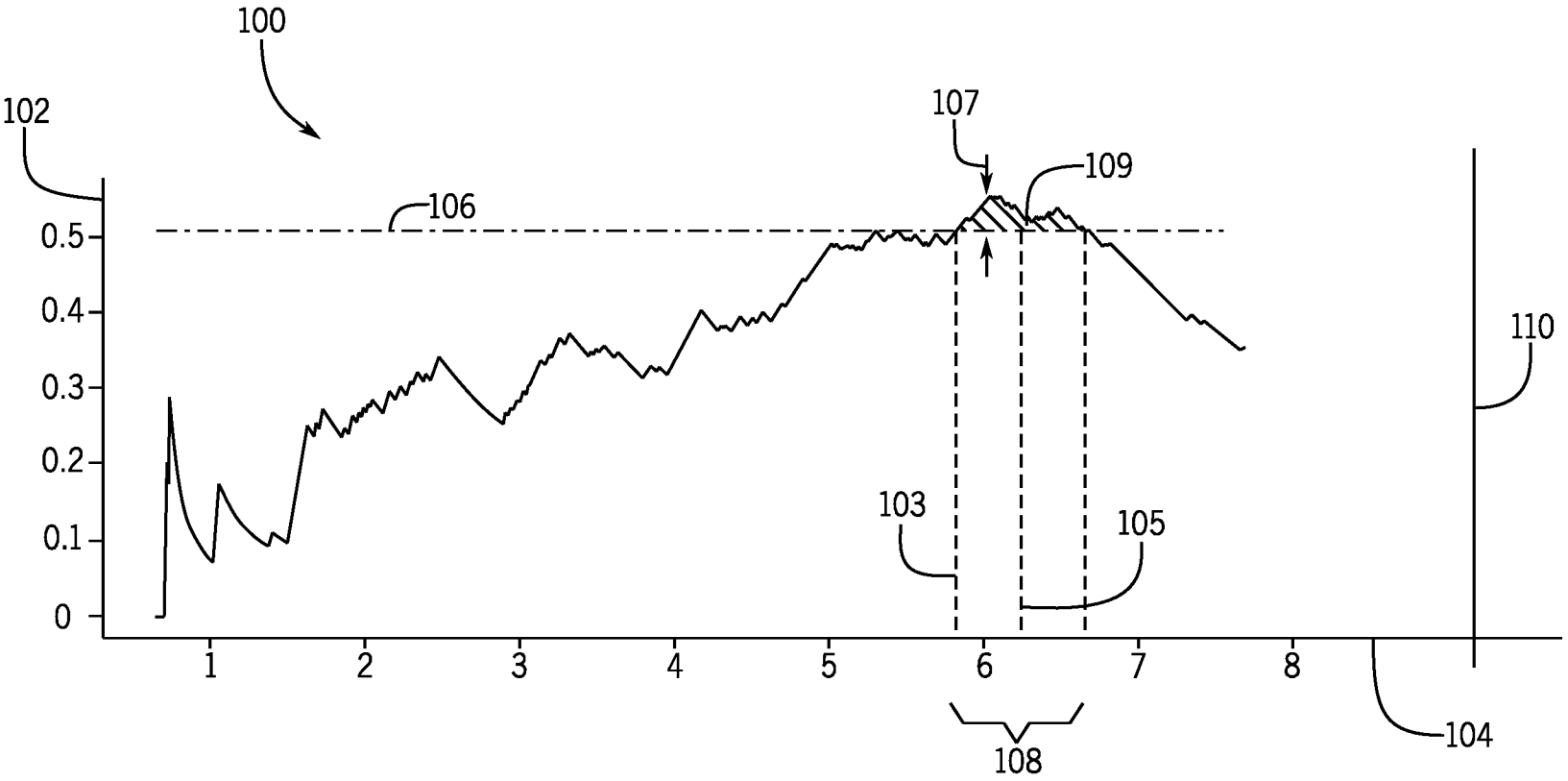
FIG. 4 is an example of a graph illustrating a health index that may be determined by the monitoring system of FIG. 2, in accordance with an embodiment of the present disclosure.

FIG. 4 is an example of a graph 100 illustrating a health index 102 over time 104 (e.g., days). The health index 102 may be determined by the computational platform 55 based on sensor data 80 obtained by the one or more sensors 48 (e.g., during test protocols). For example, sensor data 80 from the one or more sensors 48 may be recorded in log files and processed to extract various features, such as a mean change in value of the respective parameters over a time window (e.g., 10, 30, 60, 90 minutes), which may be a moving time window. The respective mean changes may be input into the model 82 to generate the health index 102. As noted above, in some embodiments, multiple models 82 may be generated, and the multiple models 82 may each be utilized to generate a respective health index for one or more components of the BOP stack assembly 16. For example, the computational platform 55 may use one model 82 (e.g., the ram BOP model) to generate one health index 102 for the ram BOP 38 and another model 82 (e.g., an annular BOP model) to generate another health index 102 for the annular BOP 36.

In some embodiments, the computational platform 55 may compare the health index 102 to a threshold 106 (e.g., predetermined threshold or health index threshold), which may be determined using the model 82 and/or based on the previously obtained sensor data 80. In some embodiments, if the health index 102 exceeds the threshold 106, the computational platform 55 may provide an alarm or an output (e.g., via the output device 153) to provide an indication that the health index 102 exceeds the threshold 106. In some embodiments, if the health index 102 exceeds the threshold 106, the computational platform 55 may determine that the condition of the component of the BOP stack assembly 16 is impaired and/or that failure is approaching and/or provide an output indicative of the determined condition and/or the predicted failure. For example, in some embodiments, the computational platform 55 may provide an alarm at a first time 103 when the health index 102 exceeds the threshold 106 and/or at a second time 105 once the health index 102 has exceeded the threshold 106 for a period of time (e.g., from the first time 103 to the second time 105). In some embodiments, the computational platform 55 may determine a remaining life and/or estimate a maintenance schedule based on the health index 102, including based on an amount 107 (e.g., value or percentage) with which the health index 102 exceeds the threshold 106, based on a time 108 over which the health index 102 exceeds the threshold 106, and/or based on an area 109 defined between the health index 102 and the threshold 106. For example, based on the health index 102, the time 108, and/or the area 109, the computational platform 55 may determine that maintenance 110 is due within a certain number of days (e.g., within approximately 1, 3, 5, 10, 15, 30, 60, 90, or the like). In some embodiments, the computational platform 55 could monitor trends in the health index 102 (e.g., slope or rate of change of the health index 102 over time), which may trigger various respective actions (e.g., alarm or control signal corresponding to a respective change in operation of the BOP stack assembly 16, such to initiate certain tests, control certain valves, or the like). In some embodiments, the computational platform 55 may compare the health index 102 to multiple thresholds each corresponding to or indicative of respective severity of the condition of the one or more components of the BOP stack assembly 16 and/or each associated with a different action (e.g., alarm or control signal corresponding to a respective change in operation of the BOP stack assembly 16, such to initiate certain tests, control certain valves, or the like). In some embodiments, the computational platform 55 may provide the output (e.g., the alarm or control signal) based on a combination of multiple different health indices 102 generated for various components of the BOP stack assembly 16.

In some embodiments, the computational platform 55 may group or sort the calculated health index 102 over a time window (e.g., 1, 3, 5, 7, 10, 14, 30, 60, 90 days or more), which may be a moving time window. The computational platform 55 may calculate a percentage of the time window over which the health index 102 exceeds the threshold 106 (e.g., a percentage of unhealthy data in the time window) and may generate an output (e.g., a health index output, a numerical value, score, or index) based on the percentage, which may then be provided via the output device 56 for visualization by the operator, for example. In some embodiments, the percentage may be designated as the health index output for a period of time (e.g., 1 day, or the last day of a seven day moving time window).

Figure 6:
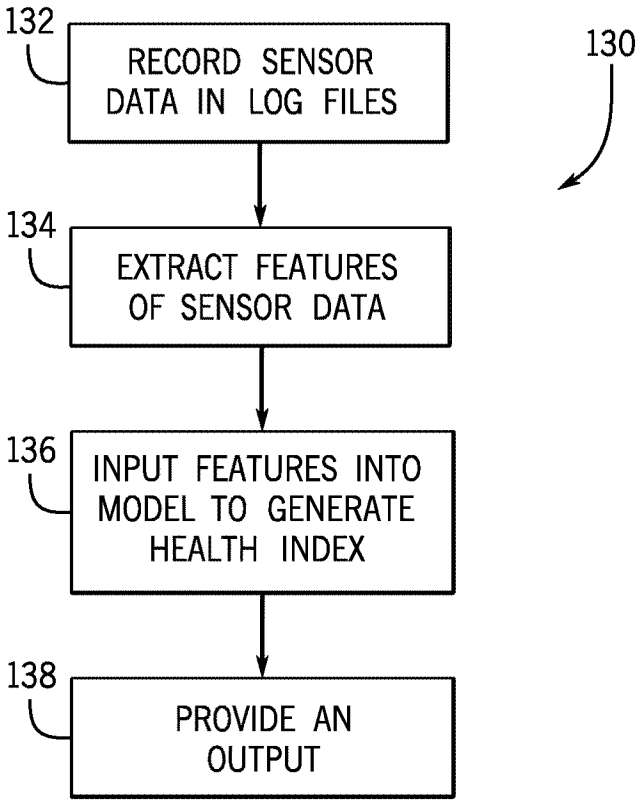
FIG. 6 is a flow diagram of a method of using the monitoring system of FIG. 2 to determine a health index, in accordance with an embodiment of the present disclosure.
Figure 5:
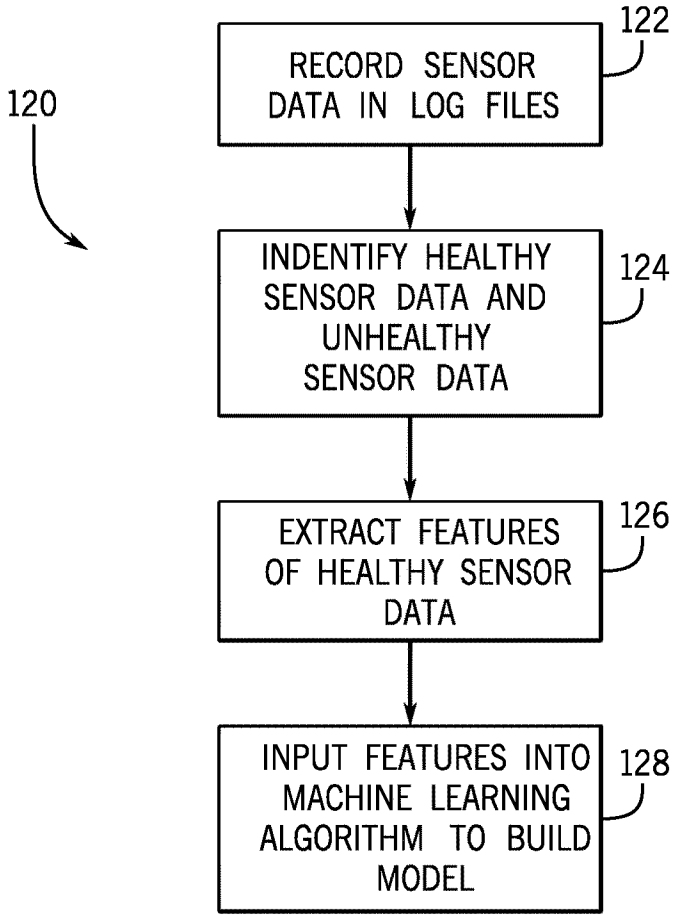
FIG. 5 is a flow diagram of a method of using the monitoring system of FIG. 2 to build a model, in accordance with an embodiment of the present disclosure.

FIGS. 5 and 6 are a flow diagrams of methods of using the monitoring system 60, in accordance with embodiments of the present disclosure. The methods includes various steps represented by blocks. It should be noted that the methods may be performed as an automated procedure by a system, such as the monitoring system 60. Although the flow charts illustrate the steps in a certain sequence, it should be understood that the steps may be performed in any suitable order and certain steps may be carried out simultaneously, where appropriate. Further, certain steps or portions of the methods may be omitted and other steps may be added. The steps or portions of the methods may be performed by separate devices. For example, a first portion of the method may be performed by the controller 50, while a second portion of the method may be performed by the computational platform 55. The methods for building the model 82 and/or assessing the components of the BOP stack assembly 16 may be carried out periodically (e.g., based on instructions stored in a memory device, such as the memory device 59, 72, 76), in response to operator input (e.g., via the input device 58), or the like.

FIG. 5 is a flow diagram of a method 120 of using the monitoring system 60 to build the model 82. In step 122, data, such as the sensor data 80 obtained from the one or more sensors 48 and/or control signals (e.g., provided by the one or more controllers 40 and/or the controller 50), may be recorded in log files (e.g., at the computational platform 55). The sensor data 80 may be obtained continuously, at predetermined intervals, and/or at certain times, such as during one or more test protocols.

In step 124, the sensor data 80 may be sorted into healthy data and unhealthy data (e.g., by the processor 57 of the computational platform 55). In some embodiments, the sensor data 80 may be sorted based on time relative to events, such as component installation, repair events, and/or maintenance events. For example, data collected within a first time window (e.g., 1 week, 2 weeks, 1 month, 2 months, 3 months, or more) prior to a maintenance or repair event may be labeled as unhealthy data. Sensor data 80 collected within a second time window (e.g., at times outside of the first window 88 and/or within 1 week, 2 weeks, 1 month, 2 months, 3 months or more after a maintenance or repair event and/or after installation of the component and/or the BOP stack assembly 16) may be labeled as healthy data. In some embodiments, the data labeled as unhealthy data may be discarded (e.g., not used to build the model 82), and the data labeled as healthy data may be used to build the model 82 (e.g., only data labeled as healthy data is used to build the model 82). As noted above, in some embodiments, the unhealthy data may additionally or alternatively be utilized to build the model 82.

In step 126, the computational platform 55 (e.g., the processor 57) may extract various features from the sensor data 80, such as from the sensor data 80 labeled as healthy data to build the model 82. For example, in some embodiments, the computational platform 55 may calculate a mean change in value of one or more of the parameters over a time window (e.g., 10, 30, 60, 90 minutes), which may be a moving time window. In step 128, the respective features (e.g., mean change) may be input into a machine learning algorithm to build the model 82, which may then be stored, such as at the memory device 59 of the computational platform 55.

FIG. 6 is a flow diagram of a method 130 of using the monitoring system 60 to assess one or more components of the BOP stack assembly 16 using the model 82. In step 132, sensor data 80 may be recorded in log files at the computational platform 55. The sensor data 80 may be obtained by the one or more sensors 48 positioned about the offshore system 10. The sensor data 80 may be obtained continuously, at predetermined intervals, and/or at certain times, such as during one or more test protocols. In step 134, the computational platform 55 may extract various features from the sensor data 80 recorded in step 132. For example, in some embodiments, the computational platform 55 may calculate a mean change in value of one or more of the parameters over a time window (e.g., 10, 30, 60, 90 minutes), which may be a moving time window.

In step 136, the extracted features (e.g., mean change) may be input into the model 82 to generate the health index 102 for one or more components of the BOP stack assembly 16. In certain embodiments, the health index 102 may be a numerical value (e.g., on a scale of 0 to 1, 1 to 10, 1 to 50, 1 to 100, or the like) and may be indicative of the condition of one or more components of the BOP stack assembly 16.

In some embodiments, the computational platform 55 may compare the health index 102 to the threshold 106 (e.g., predetermined threshold or health index threshold). In some embodiments, the computational platform 55 may determine a remaining life and/or estimate a maintenance schedule based on the health index 102, including based on an amount (e.g., value or percentage) with which the health index 102 exceeds the threshold 106, a time over which the health index 102 exceeds the threshold 106, and/or the area 109 defined between the health index 102 and the threshold 106, for example.

In step 138, the computational platform 55 may provide an output. For example, the computational platform 55 may instruct the output device 53 to provide an output indicative of the health index 102 (e.g., a numerical value, a graph, or the like), the determined condition and/or the predicted future condition of components of the BOP stack assembly 16 (e.g., impaired or healthy condition), the estimated remaining life of components of the BOP stack assembly 16 (e.g., a numerical value or percentage), and/or the predicted maintenance needs for components of the BOP stack assembly 16 (e.g., maintenance date). In some embodiments, the computational platform 55 may instruct the output device 53 to provide an alarm or a prompt (e.g., instruction, recommendation, or suggestion). In some embodiments, the computational platform 55 may be configured to instruct the controller 50 to output a control signal to automatically initiate a certain test protocol, adjust the test protocols, adjust the test schedules (e.g., frequency with which the test protocols are carried out), and/or operate actuators and/or other components of the BOP stack assembly 16 based on the health index 102, the determined condition and/or the predicted future condition of the component, the determined remaining life of the component, and/or the determined maintenance needs for the component. Thus, the monitoring system 60 may be configured to control actions to improve the health (e.g., operational effectiveness and/or efficiency) and/or the remaining life of the component.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. A monitoring system configured to monitor a blowout preventer (BOP) stack assembly of a mineral extraction system, comprising:

a processor configured to:

receive sensor data from one or more sensors positioned about the mineral extraction system;

sort the sensor data into a first set of the sensor data and a second set of the sensor data using time relative to a maintenance event, wherein the first set of the sensor data is obtained within a first time window immediately prior to the maintenance event and the second set of the sensor data is obtained prior to and outside of the first time window, and the maintenance event comprises an operation in which a component of the BOP stack assembly is repaired;

calculate a mean change in value of the second set of the sensor data over a second time window, wherein the second time window is outside of the first time window, and wherein the mean change in value of the second set of the sensor data comprises an average of a rate of change of the second set of the sensor data over the second time window;

input the mean change in value of the second set of the sensor data into a machine learning algorithm that utilizes predictive analytics on the mean change in value of the second set of the sensor data to build a model configured to generate a health index predictive of a future condition of the component of the BOP stack assembly, wherein the machine learning algorithm is configured to generate a health index threshold of the model that is based on the mean change in value of the second set of the sensor data, and wherein the first set of the sensor data is not used to build the model;

receive additional sensor data from the one or more sensors positioned about the mineral extraction system after the maintenance event;

input the additional sensor data into the model to generate the health index predictive of the future condition of the component of the BOP stack assembly;

provide an output indicative of the future condition of the component of the BOP stack assembly;

sort the additional sensor data into a first additional set of the additional sensor data and a second set of the additional sensor data using time relative to a second maintenance event, wherein the first set of the additional sensor is obtained within a third time window immediately prior to the second maintenance event and the second set of the additional sensor data is obtained prior to and outside of the third time window, and the second maintenance event comprises another operation in which the component is repaired; and input only the second set of the additional sensor data, and not the first set of the additional sensor data, into the machine learning algorithm that utilizes predictive analytics on the second set of the additional sensor data to update the model, such that the model is built and updated using both the mean change in value of the second set of the sensor data and the second set of the additional sensor data, and not any of the first set of the sensor data and the first set of the additional sensor data.

2. The monitoring system of claim 1, wherein the processor is configured to compare the health index to the health index threshold to predict the future condition of the component of the BOP stack assembly.

3. The monitoring system of claim 2, wherein the processor is configured to predict the future condition of the component of the BOP stack assembly using an amount with which the health index exceeds the health index threshold, a time over which the health index exceeds the health index threshold, an area defined between the health index and the health index threshold, a trend of the health index over time, or any combination thereof.

4. The monitoring system of claim 1, wherein the processor is configured to estimate a remaining life of the component of the BOP stack assembly and to provide the estimate of the remaining life via an output device, to estimate a maintenance schedule for the component of the BOP stack assembly and to provide the estimate of the maintenance schedule via the output device, or both.

5. The monitoring system of claim 1, wherein the additional sensor data is obtained during a test protocol to test operation of the BOP stack assembly.

6. The monitoring system of claim 5, wherein the processor is configured to provide one or more control signals to one or more actuators to initiate the test protocol, and the processor is configured to adjust a frequency of the test protocol based on the health index.

7. The monitoring system of claim 1, wherein the sensor data is indicative of at least two of a pressure, a fluid flow rate, a temperature, a fluid content, an angle of inclination, and a power supply.

8. The monitoring system of claim 1, wherein the output comprises a displayed output of the health index, an estimated remaining life, or a maintenance schedule.

9. The monitoring system of claim 1, wherein the component comprises a sensor of the one or more sensors.

10. The monitoring system of claim 1, wherein the processor is configured to calculate a percentage of a moving time window over which the health index exceeds the health index threshold and to generate an output based on the percentage.

11. A method of monitoring a component of a blowout preventer (BOP) stack assembly of a mineral extraction system, comprising:

receiving, at a processor, sensor data from multiple sensors positioned about the mineral extraction system;

sorting, using the processor, the sensor data into a first set of the sensor data and a second set of the sensor data using time relative to a maintenance event, wherein the first set of the sensor data is obtained within a first time window immediately prior to the maintenance event and the second set of the sensor data is obtained prior to and outside of the first time window, and the maintenance event comprises an operation in which the a component is repaired;

calculating a mean change in value of the second set of the sensor data over a second time window, wherein the second time window is outside of the first time window, and wherein the mean change in value of the second set of the sensor data comprises an average of a rate of change of the second set of the sensor data over the second time window;

inputting, using the processor, only the mean change in value of the second set of the sensor data, and not the first set of the sensor data, into a machine learning algorithm that utilizes predictive analytics on the mean change in value of the second set of the sensor data to build a model, and wherein the machine learning algorithm is configured to generate a health index threshold of the model based on the mean change in value of the second set of the sensor data;

subsequently receiving, at the processor, additional sensor data from the multiple sensors positioned about the mineral extraction system after the maintenance event;

inputting, using the processor, the additional sensor data into the model to generate a health index that is predictive of a future condition of the component of the BOP stack assembly;

sorting, using the processor, the additional sensor data into a first additional set of the additional sensor data and a second set of the additional sensor data using time relative to a second maintenance event, wherein the first set of the additional sensor is obtained within a third time window immediately prior to the second maintenance event and the second set of the additional sensor data is obtained prior to and outside of the third time window, and the second maintenance event comprises another operation in which the component is repaired; and inputting, using the processor, only the second set of the additional sensor data, and not the first set of the additional sensor data, into the machine learning algorithm that utilizes predictive analytics on the second set of the additional sensor data to update the model, such that the model is built and updated using both the mean change in value of the second set of the sensor data and the second set of the additional sensor data, and not any of the first set of the sensor data and the first set of the additional sensor data.

12. The method of claim 11, comprising comparing the health index to the health index threshold to predict the future condition of the component, using the processor.

13. The method of claim 12, comprising predicting the future condition of the component using an amount with which the health index exceeds the health index threshold, a time over which the health index exceeds the health index threshold, an area defined between the health index and the health index threshold, or any combination thereof, using the processor.

14. The method claim 11, comprising:

estimating a remaining life of the component and instructing an output device to provide the estimate of the remaining life, using the processor; and estimating a maintenance schedule for the component and instructing the output device to provide another indication of the estimate of the maintenance schedule, using the processor.

15. The method of claim 11, comprising conducting a test protocol to test operation of the BOP stack assembly and, using the processor, inputting the additional sensor data obtained during the test protocol into the model to generate the health index.

16. The method of claim 11, wherein the second time window comprises a moving time window.

17. The method of claim 11, comprising using the first set of the sensor data, and not the second set of the sensor data, to test the model.

18. The method of claim 11, wherein the second set of the sensor data is healthy data that is indicative of the component being in a healthy state and the first set of the sensor data is unhealthy data that is indicative of the component being in a unhealthy state compared to the healthy state.

19. A monitoring system comprising, a processor configured to:

input baseline sensor data into a machine learning algorithm that utilizes predictive analytics on the baseline sensor data to build a model configured to generate a health index predictive of a future condition of a component of a blowout preventer (BOP) stack assembly of a mineral extraction system, wherein the machine learning algorithm is configured to generate a health index threshold of the model based on the baseline sensor data;

receive subsequent sensor data from multiple sensors positioned about the mineral extraction system;

input the subsequent sensor data into the model to generate the health index;

provide an output indicative of the future condition of the component of the BOP stack assembly;

sort the subsequent sensor data into a first set and a second set using time relative to a maintenance event, wherein the first set is obtained within a first time window immediately prior to the maintenance event and the second set is obtained prior to and outside of the first time window;

calculate a mean change in value of the second set over a second time window, wherein the second time window is outside of the first time window, and wherein the mean change in value of the second set comprises an average of a rate of change of the second set over the second time window; and input only the mean change in value of the second set, and not the first set, into the machine learning algorithm to update the model such that the model is built using the baseline sensor data, the model is updated using the second set, and the model is not built or updated using the first set.

20. The monitoring system of claim 19, wherein the baseline sensor data is indicative of a pressure, a fluid flow rate, a temperature, a fluid content, an angle of inclination, a power supply, or any combination thereof, and the processor is configured to:

extract features from the baseline sensor data and input the features into the machine learning algorithm to build the model;

wherein the features comprise a respective mean change over a respective time window, the baseline sensor data is obtained by the multiple sensors within a third time window that is immediately following installation of the component, and the maintenance event comprises an operation in which the component of the BOP is repaired.

21. The monitoring system of claim 19, wherein the baseline sensor data comprises data obtained by additional sensors positioned about an additional mineral extraction system that is physically separate from the mineral extraction system.

* * * * *